US008794558B2

(12) United States Patent
Pausch et al.

(10) Patent No.: US 8,794,558 B2
(45) Date of Patent: Aug. 5, 2014

(54) DYNAMIC ELEMENT FOR THE SEPARATING DEVICE OF A STIRRING BALL MILL

(71) Applicants: Horst Pausch, Schwarzenbach/Saale (DE); Jan Wolfrum, Selbitz (DE)

(72) Inventors: Horst Pausch, Schwarzenbach/Saale (DE); Jan Wolfrum, Selbitz (DE)

(73) Assignee: Netzsch-Feinmahltechnik GmbH (DE)

( * ) Notice: Subject to any disclaimer, the term of this patent is extended or adjusted under 35 U.S.C. 154(b) by 0 days.

(21) Appl. No.: 13/907,477

(22) Filed: May 31, 2013

(65) Prior Publication Data

US 2013/0264402 A1 Oct. 10, 2013

Related U.S. Application Data

(63) Continuation of application No. PCT/DE2011/002060, filed on Dec. 1, 2011.

(30) Foreign Application Priority Data

Dec. 4, 2010 (DE) ..... 10 2010 053 484

(51) Int. Cl.
*B02C 17/16* (2006.01)

(52) U.S. Cl.
USPC ..... 241/171; 241/172

(58) Field of Classification Search
CPC ..... B02C 25/00; B02C 18/0007; B02C 2018/168; B02C 17/14; B02C 17/16; B02C 17/005; B02C 17/161; B02C 17/163
USPC ..... 241/30, 170–172
See application file for complete search history.

(56) References Cited

U.S. PATENT DOCUMENTS 5,333,804 A * 8/1994 Liebert ..... 241/69
5,464,163 A * 11/1995 Zoz ..... 241/172
5,474,237 A * 12/1995 Bishop et al. ..... 241/21
5,518,191 A * 5/1996 Bartsch et al. ..... 241/46.11
5,597,126 A * 1/1997 Frommherz et al. ..... 241/172

(Continued)

FOREIGN PATENT DOCUMENTS

DE 102007043670 A1 4/2009
EP 0260604 A2 3/1988

(Continued)

OTHER PUBLICATIONS

International Search Report Application No. PCT/DE2011/002060 Completed: Jul. 2, 2012; Mailing Date: Jul. 12, 2012 2 pages.

*Primary Examiner* — Mark Rosenbaum
*Assistant Examiner* — Onekki Jolly
(74) *Attorney, Agent, or Firm* — St. Onge Steward Johnston & Reens LLC

(57) ABSTRACT

An agitator ball mill with a cylindrical grinding container is disclosed. The grinding container includes at least one grinding stock inlet and at least one grinding stock outlet. An agitator shaft connected to a drive is disposed in the grinding container. The agitator shaft transmits a part of the drive energy of the drive to the auxiliary grinding bodies. The auxiliary grinding bodies are distributed loosely in the grinding container. Furthermore, the agitator ball mill includes a separation device assigned to the grinding stock outlet, wherein the separation device is disposed around a rotational axis and/or rotates around this rotational axis. The separation device includes at least two components, whereof one component is at least one separation device and a second component is a dynamic element for generating a material flow.

11 Claims, 6 Drawing Sheets

(56) References Cited

U.S. PATENT DOCUMENTS

| | | | | |
|---|---|---|---|---|
| 5,934,579 | A * | 8/1999 | Hiersche et al. | 241/65 |
| 7,014,134 | B2 * | 3/2006 | Heinzelmann et al. | 241/171 |
| 2009/0072060 | A1 * | 3/2009 | Pausch | 241/171 |

FOREIGN PATENT DOCUMENTS

| | | | |
|---|---|---|---|
| EP | 0627262 | A1 | 12/1994 |
| EP | 1468739 | A1 | 10/2004 |
| EP | 1970124 | A2 | 9/2008 |

* cited by examiner

DYNAMIC ELEMENT FOR THE SEPARATING DEVICE OF A STIRRING BALL MILL

FIELD OF THE INVENTION

The present invention relates to a separation device with a dynamic element for agitator ball mills.

BACKGROUND OF THE INVENTION

German patent application DE 10 2007 043 670 A1 discloses an agitator ball mill with a cylindrical grinding container, wherein an agitator shaft connected to a drive is disposed in the grinding container. The agitator shaft transmits a part of the drive energy to the auxiliary grinding bodies which are disposed loosely in the grinding container. A helical separating device is disposed in front of the grinding stock outlet.

European patent application EP 1 468 739 A1 discloses a continuously operating horizontal agitator ball mill used for the fine and ultrafine grinding of a material, said agitator ball mill comprising a cylindrical or conical grinding chamber for receiving grinding bodies. A stock inlet emerging into the interior of the grinding chamber is disposed at one end of the grinding chamber. A stock outlet leading out of the interior space is located at the other end of the grinding chamber. Furthermore, an agitator coaxial with the chamber axis and comprising a plurality of agitator elements is present. Disposed in front of the stock exit is a separately driven separation system, which separates the grinding bodies from the ground stock and conveys them back into the interior of the grinding chamber. The separation system is formed by a separating element, which comprises two circular discs disposed coaxial with the chamber axis. A plurality of conveying or blade elements, which are distributed symmetrically around the centre-point of the discs and point inwards from the edge of the discs, is disposed between the circular discs. When the separation device is in operation, the blade elements generate a counter-pressure on the stock/grinding body mixture, so that the grinding bodies are separated from the product due to the centrifugal force and the different specific density and are conveyed back into the interior.

European patent specification EP 0 627 262 B1 discloses a continuously operating agitator ball mill used for the fine and ultrafine grinding of a material. This agitator ball mill is provided with a cylindrical or conical grinding chamber serving to receive grinding bodies. Disposed at one end of the grinding chamber is a grinding stock inlet which emerges into the interior of the grinding chamber. Disposed at the other end of the grinding chamber is a grinding stock outlet which leads out of the interior. Furthermore, the agitator ball mill comprises agitator elements and an agitator moving coaxially with the grinding chamber axis for the purpose for moving the grinding bodies, wherein the agitator elements are constituted paddlewheel- or propeller-like and comprise a plurality of conveying elements. A circular disc is disposed respectively on both sides of the conveying elements, wherein at least one of the two discs comprises at least one central opening. The mixture formed by the grinding bodies and the stock to be ground can flow through the central opening. The agitator elements are constituted and dimensioned in such a way that, during the operation of the agitator ball mill, a part of the mixture continuously flows back radially inwards towards the central opening over the edge of the disc comprising the central opening. The mixture flows from there back into the intermediate space between the discs. A uniform axial distribution of the grinding bodies in the interior of the grinding chamber is thus obtained.

European patent EP 1 970 124 A2 discloses an agitator ball mill with a separation device for auxiliary grinding bodies, to which a preliminary classification device is assigned. This preliminary classification device comprises a cylinder which is provided with perforations. The perforations comprise circular holes or oval perforations or slots in the cylinder wall. A distance of 2 to 30 times the diameter of the perforations introduced in the cylinder exists between the separation device and the perforations in the cylinder.

SUMMARY OF THE INVENTION

The problem underlying the invention is to create a separation device with which the removal of auxiliary grinding bodies from the agitator ball mill can be prevented.

The above problem is solved by means of a separation device in an agitator ball mill according to the present teachings. Further advantageous features can also be found in the present teachings.

A further problem of the invention is to make available a method with which the removal of auxiliary grinding bodies from an agitator ball mill can be prevented.

This problem is solved by a method for operating an agitator ball mill according the present teachings.

An agitator ball mill with a cylindrical grinding container is disclosed. The grinding container comprises at least one grinding stock inlet and at least one grinding stock outlet. An agitator shaft connected to a drive is disposed in the grinding container. The agitator shaft transmits a part of the drive energy of the drive to the auxiliary grinding bodies. The auxiliary grinding bodies are distributed loosely in the grinding container. Furthermore, the agitator ball mill comprises a separation device assigned to the grinding stock outlet, wherein the separation device is disposed around a rotational axis and/or rotates around this rotational axis. The separation device comprises at least two components, whereof one component is at least one separation element and a second component is a dynamic element for generating a material flow. The dynamic element is provided with radially running channels or blades.

The agitator shaft of the agitator ball mill is provided with a completely or partially slotted cage. The dynamic element of the separation device is disposed at a distance from an end part of the grinding container. The distance between the dynamic element and the end part can be adjusted from 0.5 mm to 30 mm. In a preferred embodiment, the distance can be adjusted from 2 mm to 15 mm. As a result of this adjustability, it is possible to adapt the separation device to different product and/or production conditions without exchanging components.

The surface of the dynamic element and the end part of the grinding container are disposed conically with respect to one another. The angle between the rotational axis and the surface of the element and respectively between the rotational axis and the end part is designed in the range from 5° to 85°. In a preferred embodiment, the angle has a value from 15° to 80°.

The value for the ratio of the length of the separation device to the agitator shaft length lies in the range between 1:1.1 and 1:2. Depending on how the separation device is constituted, the value for the ratio can also lie in the range between 1:1.3 and 1:1.7.

The ratio of the external diameter of the separation device to the internal diameter of the cage lies in a value range from 1:1.05 to 1:2. Furthermore, the ratio of the external diameter of the separation device to the external diameter of the end part of the grinding container is important for the function of the separation device. This ratio lies in a range between 1:1 and 1:1.2.

The drive of the cage takes place via the drive shaft. Furthermore, a separate drive can be provided to generate the rotary motion of the separation device. Various embodiments are possible for the design of the separation device. The separation element can be a sieve, a sieve cartridge or a helix. Many separation elements for agitator ball mills are known from the prior art. These known separation elements can also be combined with the dynamic element according to the invention.

It is clear to the person skilled in the art that all the numerical data stated in the description of the device (agitator ball mill) describe preferred embodiments. The stated data do not therefore represent a conclusive limitation of the scope of protection.

Furthermore, a method for operating an agitator ball mill with a separation device according to the invention is disclosed. A separation device is used here which comprises at least two components, wherein at least one separation device is combined with at least one dynamic element to generate a material flow. A material circulation takes place inside the grinding container between the outlet of the separation device and its inlet. As a result of the material circulation, it is no longer possible for auxiliary grinding bodies to enter into a gap formed by a distance between the dynamic element and the end part of the grinding container. The dynamic element generates a flow between the outlet and the inlet of the separation device.

The separation element and the dynamic element are driven with one another and/or independently of one another, and coupled with the agitator shaft or uncoupled from the latter. Depending on the material that is being processed in the agitator ball mill, it may be advisable to adjust different operational states. It may also be advisable here to move the agitator shaft in a rotating manner at a different speed from the combination comprising separation element and dynamic element.

The pressure that is generated by the circulation flow is higher in the transition region to the cage than at the end of the separation device. A material flow directed radially from the rotational axis towards the agitator shaft arises as a result of the rotational movement of the dynamic element.

Examples of embodiment of the invention and its advantages are explained in detail below with the aid of the appended figures. The size ratios of the individual elements with respect to one another in the figures do not always correspond to the actual size ratios, since some forms are represented simplified and others, for the sake of better clarity, magnified in relation to the other elements.

DETAILED DESCRIPTION OF THE INVENTION

Identical reference numbers are used for identical or identically acting elements of the invention. Furthermore, the sake of clarity, only those reference numbers are shown in the individual figures that are essential for description of the given figure.

Figure 1:
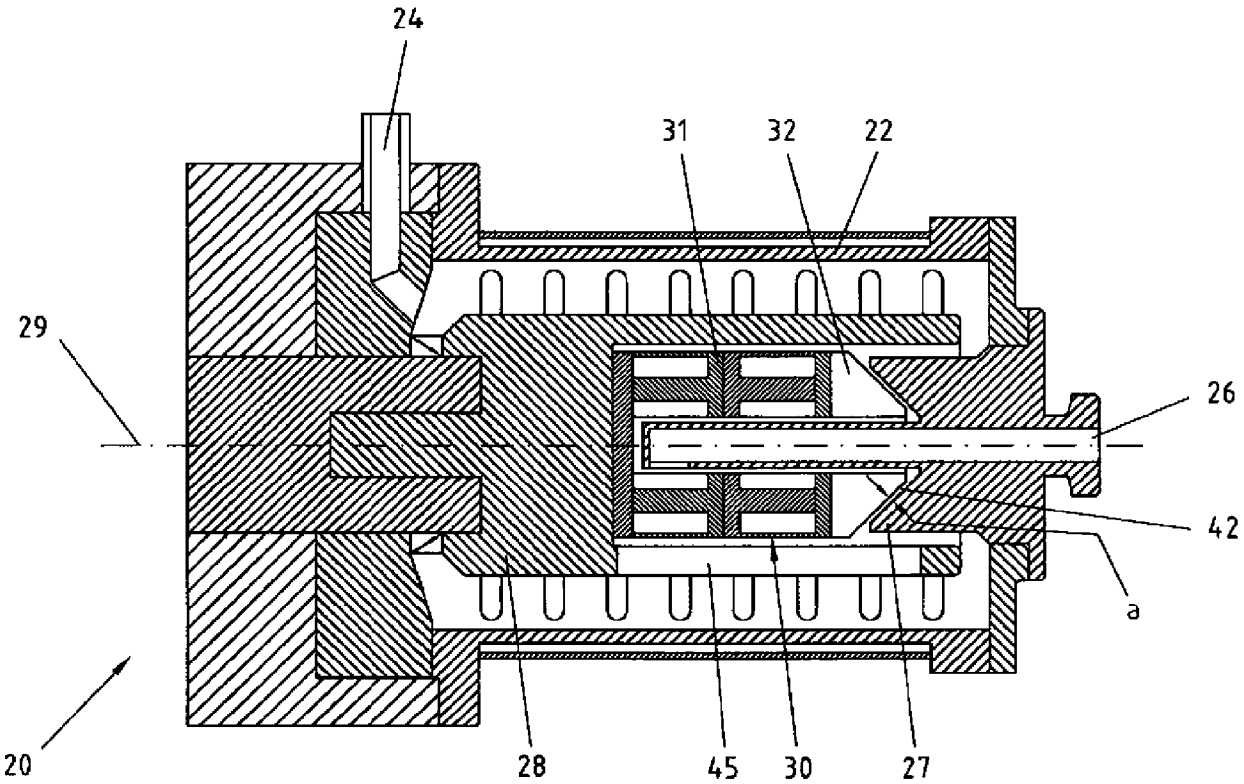
FIG. 1 shows the diagrammatic structure of an agitator ball mill according to the invention with a helical separation device.

FIG. 1 shows the diagrammatic structure of an agitator ball mill 20 according to the invention with a separation device 30. Represented agitator ball mill 20 comprises a grinding container 22 which is provided with a grinding stock inlet 24 and a grinding stock outlet 26. An agitator shaft 28 is disposed centrally in grinding container 22. Separation device 30 is disposed inside agitator shaft 28. The part of agitator shaft 28 that surrounds separation device 30 is referred to as cage 44. This cage 44 can comprise axial cutouts 45 or suchlike, so that auxiliary grinding bodies, for example, can pass back into grinding container 22 through these axial cutouts 45. In the example of the embodiment represented in FIG. 1, separation element 31 is constituted helical. A dynamic element 32 for generating a material flow is assigned to separation element 31. Dynamic element 32 is positioned at a distance from end part 27 of grinding body 22. The grinding stock can flow between dynamic element 32 and end part 27 through gap 42 defined as distance a. The material flow is generated by a rotational movement of element 32 about rotational axis 29.

Figure 2:
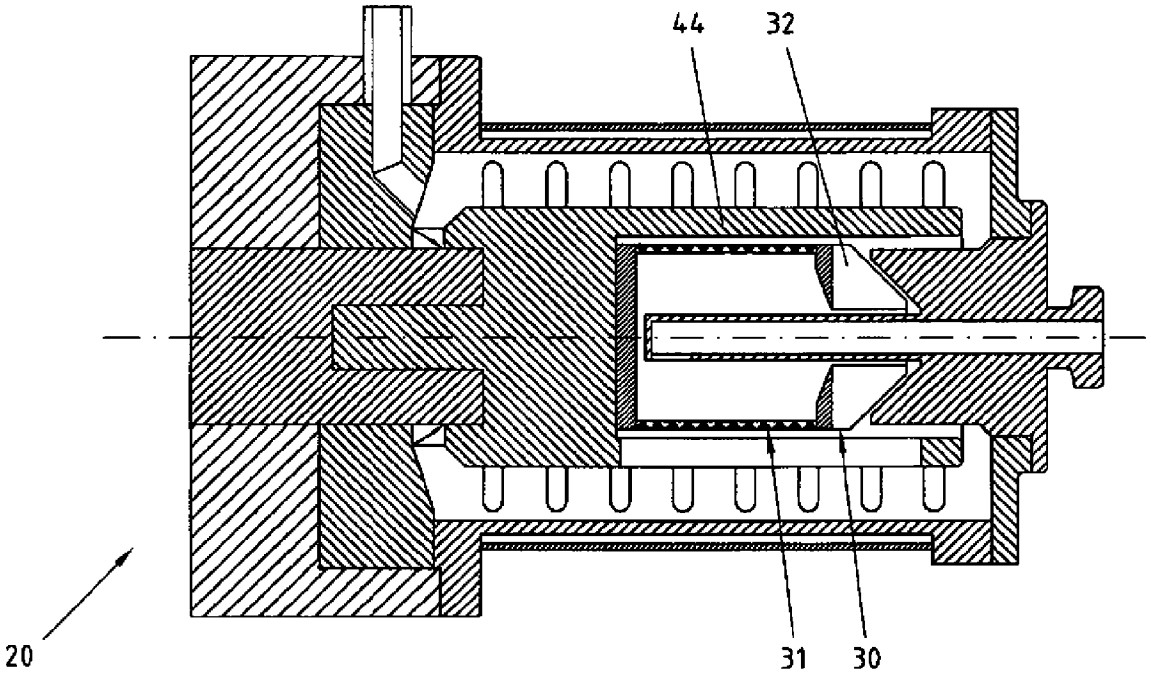
FIG. 2 shows the diagrammatic structure of an agitator ball mill according to the invention, wherein the main separation device is a sieve cartridge.

FIG. 2 shows the diagrammatic structure of an agitator ball mill 20 according to the invention, wherein separation element 31 is a sieve or a sieve cartridge. Separation device 31 is coupled with a dynamic element 32 for generating a material flow.

Figure 3A:
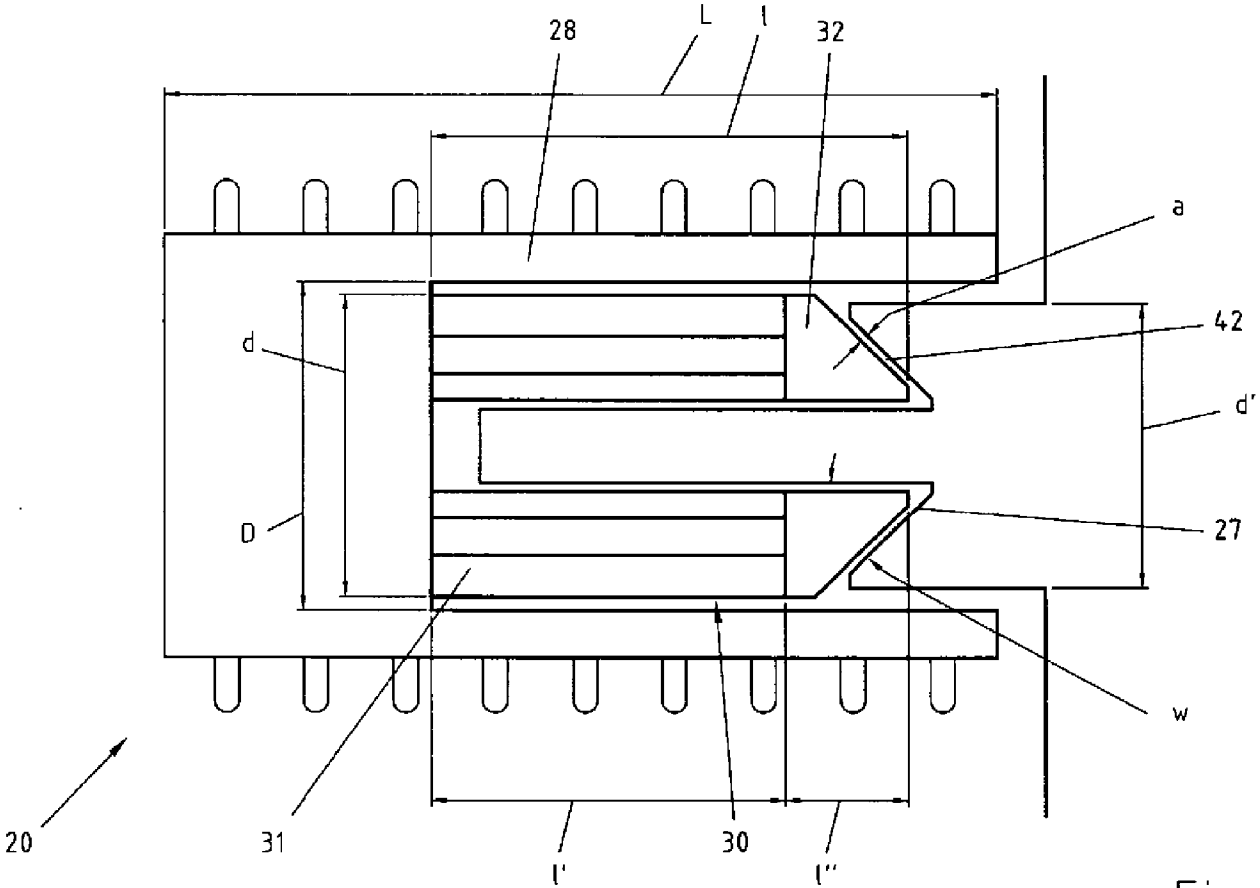
FIGS. 3*a* and 3*b* show the length and diameter ratios of various separation device configurations.
Figure 3B:
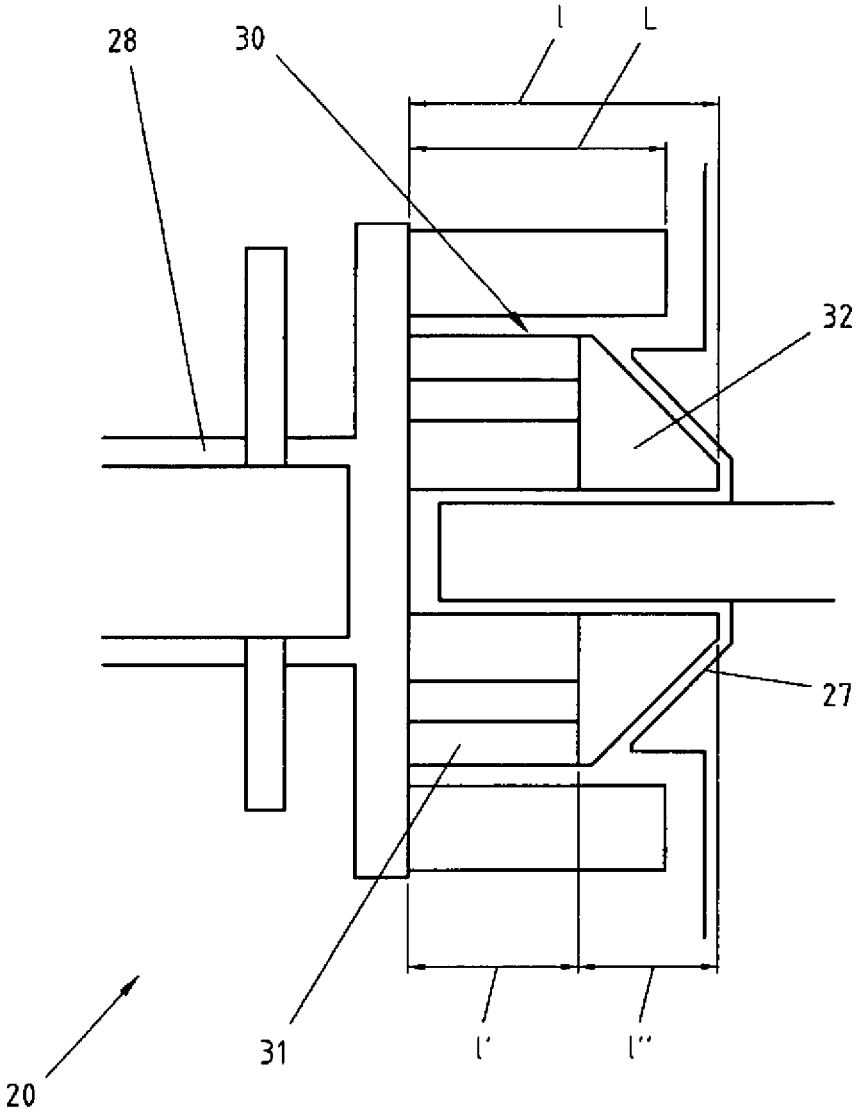

FIGS. 3*a* and 3*b* show the length and diameter ratios of different separation device configurations. An agitator ball mill 20 with a long separation element 31 is represented in FIG. 3*a*. FIG. 3*b*, on the other hand, shows an agitator ball mill 20 with a short separation element 31.

Separation device 30 is surrounded by agitator shaft 28 in agitator ball mill 20 represented in FIG. 3*a*. Separation element 31 with a length l' is followed by dynamic element 32 with length l". Agitator shaft 28, with a length L, is much longer than separation device 30 with length l. A gap 42 is formed between dynamic element 32 and end part 27. Gap width 42 is determined by distance a, which can be adapted according to the embodiment of agitator ball mill 20 and according to the size of the auxiliary grinding bodies (not represented). It is important for the function of separation device 30 that dynamic element 32 and end part 27 are disposed relative to one another not only at a defined distance a, but also at a defined angle w. Furthermore, it can be seen that internal diameter D of agitator shaft 28 is minimally greater than external diameter d of separation device 30. External diameter d' of end part 27 is however much smaller than internal diameter D of agitator shaft 28.

FIG. 3*b* is identical to FIG. 3*a* apart from the length of separation device 30 and its various components. Length l of separation device 30 is composed of length l' of separation device 31 and length l" of dynamic element 32. In the embodiment represented in FIG. 3*b*, length L of agitator shaft 28 is however smaller than length l of separation device 30. Furthermore, end part 27 is only slightly superimposed by agitator shaft 28.

Figure 4:
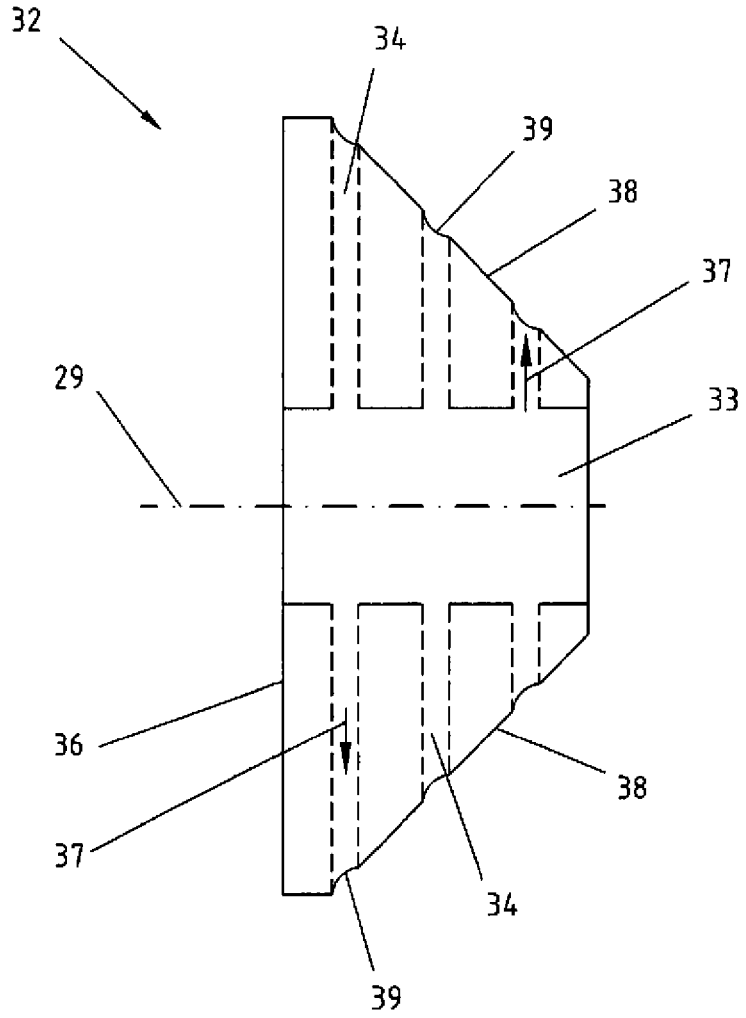
FIG. 4 shows the diagrammatic structure of a dynamic element.

FIG. 4 shows a diagrammatic structure of a dynamic element 32 for generating a material flow. Element 32 is constituted in such a way that it runs rotation-symmetrically around rotational axis 29. In the installed state, contact side 36 of element 32 is in an active interrelationship with a separation device (not represented). Grinding stock is sucked out of the separation device via a central bore 33 and is conveyed again radially outwards in flow direction 37 via channels 34. The grinding stock flow can exit from element 32 through openings 39 on effective surface 38 of element 32. The conical design of effective surface 38 of element 32 can clearly be seen. The cross-section of the element diminishes in the direction towards the end part (not represented).

Figure 5:
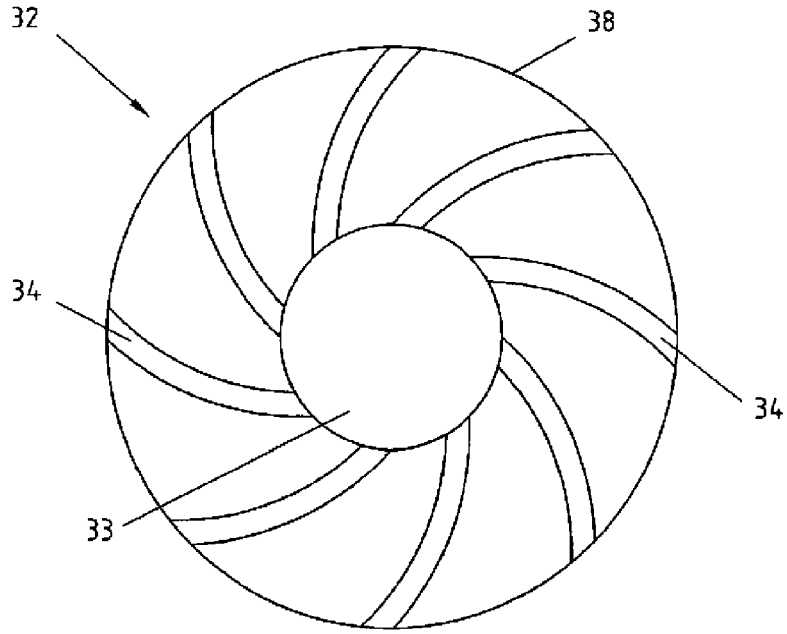
FIGS. 5 and 6 show diagrammatically possible embodiments of the dynamic element.
Figure 6:
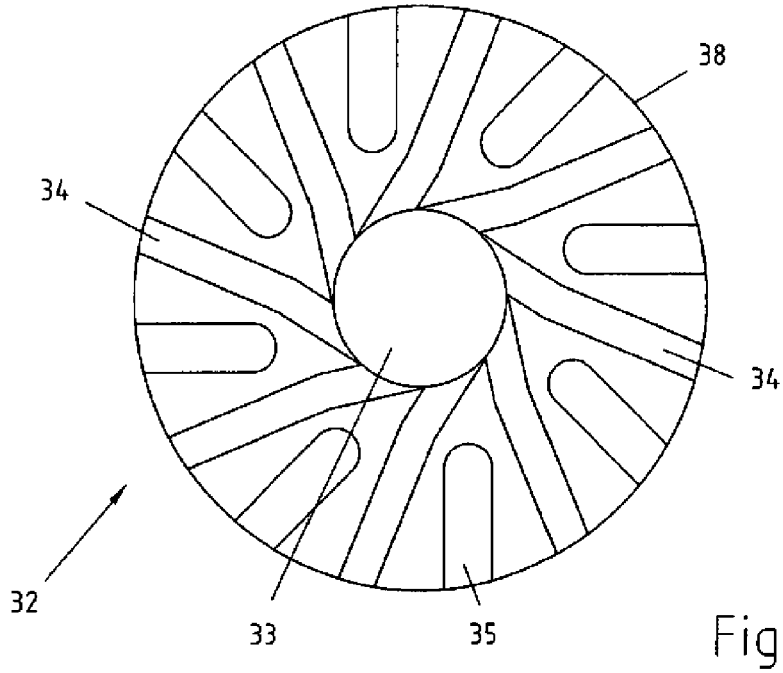

FIGS. 5 and 6 show diagrammatically possible embodiments of dynamic element 32. FIG. 5 shows a dynamic element 32 in a front view. Channels 34 for generating a material flow run in an arc-shaped line from central bore 33 outwards towards effective surface 38 of element 32.

FIG. 6 represents a further embodiment of a dynamic element 32. Channels 34 run from central bore 33 radially outwards towards effective surface 38. Short channels 35 are hidden by the material of element 32 in the region of central bore 33. As a result of the conical design of element 32, these short channels 35 do not emerge until in the vicinity of the contact side (not represented).

The invention has been described by reference to a preferred embodiment.

What is claimed is:

1. An agitator ball mill with a cylindrical grinding container which comprises at least one grinding stock inlet and at least one grinding stock outlet, wherein an agitator shaft connected to a drive is disposed in the grinding container, said agitator shaft transmitting a part of the drive energy to auxiliary grinding bodies, wherein the auxiliary grinding bodies are distributed loosely in the grinding container, and a separation device assigned to the grinding stock outlet of the agitator ball mill, wherein the separation device is disposed around a rotational axis and/or rotates around this rotational axis, characterised in that the separation device comprises at least two components, whereof one component is at least one separation element and a second is a dynamic element, said dynamic element being provided with radially running channels or blades for generating a material flow.

2. The agitator ball mill according to claim 1, characterised in that the agitator shaft is provided with a completely or partially slotted cage.

3. The agitator ball mill according to claim 1, characterised in that the dynamic element is disposed at a distance from the end part of the grinding container.

4. The agitator ball mill according to claim 3, characterised in that the distance can be adjusted from 0.5 mm to 30 mm.

5. The agitator ball mill according to claim 1, characterised in that a surface of the dynamic element and the end part of the grinding container are disposed conically with respect to one another.

6. The agitator ball mill according to claim 1, characterised in that the ratio of the length of the separation device to the agitator shaft length lies in the range between 1:1.1 and 1:2.

7. The agitator ball mill according to claim 1, characterised in that the ratio of the external diameter of the separation device to the internal diameter of the cage lies in a range from 1:1.05 to 1:2.

8. The agitator ball mill according to claim 1, characterised in that the ratio of the external diameter of the separation device to the external diameter of the end part of the grinding container lies in a range between 1:1 and 1:1.2.

9. The agitator ball mill according to claim 1, characterised in that the drive of the cage takes place via the agitator shaft.

10. The agitator ball mill according to claim 1, characterised in that a separate drive for generating the rotational movement of the separation device is provided.

11. The agitator ball mill according to claim 1, characterised in that the separation element is a sieve, a sieve cartridge or a helix.

* * * * *